US006130385A

United States Patent [19]

Tuunanen et al.

[11] Patent Number: 6,130,385

[45] Date of Patent: Oct. 10, 2000

[54] COAXIAL HIGH-FREQUENCY CABLE AND DIELECTRIC MATERIAL THEREOF

[75] Inventors: Vesa Tuunanen, Helsinki, Finland; Hans-Bertil Martinsson, Varekil, Sweden

[73] Assignee: NK Cables Oy, Espoo, Finland

[21] Appl. No.: 09/202,927

[22] PCT Filed: Jul. 1, 1997

[86] PCT No.: PCT/FI97/00428

§ 371 Date: Feb. 23, 1999

§ 102(e) Date: Feb. 23, 1999

[87] PCT Pub. No.: WO98/01870

PCT Pub. Date: Jan. 15, 1998

[30] Foreign Application Priority Data

Jul. 1, 1996 [FI] Finland ..... 962715

[51] Int. Cl.[7] ..... H01B 7/00

[52] U.S. Cl. ..... 174/110 PM; 174/110 F

[58] Field of Search ..... 174/110 F, 110 PM, 174/28; 428/195, 424.8

[56] References Cited

U.S. PATENT DOCUMENTS

| | | | |
|---|---|---|---|
| 3,040,278 | 6/1962 | Griemsmann | 174/110 F X |
| 3,516,859 | 6/1970 | Gerland et al. | 174/110 F X |
| 3,968,463 | 7/1976 | Boysen | 174/110 F X |
| 4,204,086 | 5/1980 | Suzuki . | |
| 4,472,595 | 9/1984 | Fox et al. | 174/36 |
| 4,683,166 | 7/1987 | Yuto et al. | 428/314.8 |
| 4,789,589 | 12/1988 | Baxter | 174/110 F X |
| 5,574,074 | 11/1996 | Zushi et al. | 521/143 |

FOREIGN PATENT DOCUMENTS

| | | |
|---|---|---|
| 611793A2 | 8/1994 | European Pat. Off. . |

*Primary Examiner*—Kristine Kincaid
*Assistant Examiner*—Chau N. Nguyen
*Attorney, Agent, or Firm*—Birch, Stewart, Kolasch & Birch

[57] ABSTRACT

The invention relates to a coaxial high-frequency cable including an inner conductor, a dielectric material formed about the inner conductor, and an outer conductor formed about the dielectric material. According to the invention, the dielectric material is made from an expanded polymer blend compounded from two a-olefin polymers of different densities, whereby the polymer of the higher density forms the matrix of the polymer blend.

18 Claims, 3 Drawing Sheets

COAXIAL HIGH-FREQUENCY CABLE AND DIELECTRIC MATERIAL THEREOF

This application is the national phase under 35 U.S.C. §371 of prior PCT International Application No. PCT/FI97/00428 which has an International filing date of Jul. 1, 1998 which designated the United States of America.

BACKGROUND OF THE INVENTION

1. Field of the Invention

The present invention relates to a coaxial high-frequency cable.

The invention also concerns a dielectric material for use in a cable.

The invention can be utilized in the transfer of a radio-frequency signal, whether digital or analog, when the signal transfer system requires a low attenuation over the transmission path. Typically, such an application is in the high-power transmission from the power amplifier stage of a radio transmitter to the radiating antenna element proper or connection of a receiving antenna to the input stage of a radio receiver, or a combination of similar signal paths. An example of such an application is found at the base stations of cellular phone networks. Another application is in the radio-shadow areas of said cellular phone systems such as tunnels, cellars, etc., where this type of cable can be used as the radiating element when provided with a perforated leaky outer conductor. Also in cable-TV networks in which the transmitted signal conveys both analog and digital television pictures, the cable according to the invention is useful, as well as on the subscriber lines of modern telephone systems (access networks) which use a coaxial cable as the transmission medium in the transfer of wideband information. Furthermore, the invention is useful in symmetrical cabling of a wideband data network. The benefits of the invention are the higher the wider the required transmission bandwidth, typically ranging from a few megahertz to a few gigahertz.

2. Description of the Background Art

Cable structures of both coaxial and symmetrical construction suitable for high-frequency transmission have been made in the art with a polymer dielectric as soon as polyolefin polymers of suitable qualities appeared on the market in the 1940's. In order to achieve a low permittivity ($\epsilon_r$) and dissipation factor (tan $\delta$), a countless number of polymer-air dielectric material combinations have been tested over times in order to maximize the fraction of air in the dielectric with the goal of minimizing the attenuation constant of the cable without compromising the mechanical handling properties of the cable. As rule of thumb, the mechanical bending endurance, compression resistance and other durability-related properties are deteriorated when the volume of the solid dielectric material is reduced and replaced by a gaseous medium, whereby the attenuation and dissipation factor of the cable are decreased. A good compromise has been found in an expanded polymer dielectric, conventionally polyethylene, which is formed by foaming from an initially solid polymer dielectric material in an extruder during the cable insulation process.

In early attempts, the foaming step was implemented by compounding the polymer raw material with a specific chemical foaming agent which was capable of blowing closed cells of desired size in the polymer dielectric. A problem of this approach is that the polymer dielectric material traps residues of the foaming agent that deteriorate the dissipation factor and attenuation at the upper end of the frequency range. Partially with the goal to overcome this drawback, physical foaming methods were developed based on injecting into the extrusion process some inert gas, originally fluorocarbon gas but later nitrogen or carbon dioxide, in order to blow the gas-filled expanded cells. Practical experience has, however, shown that both of these prior-art foaming methods will at some state reach certain ultimate limits of attenuation and dissipation factor that cannot be exceeded, because the foaming ratio cannot be passed further due to the deterioration of mechanical properties and because the basic qualities of available polymer grades, which determine the achievable electrical properties, are already maximally exploited.

SUMMARY OF THE INVENTION

It is an object of the present invention to overcome the drawbacks of the above-described technique and to provide an entirely novel type of coaxial high-frequency cable and its dielectric material.

The goal of the invention is achieved by making the dielectric of the coaxial cable from a material which consists of a polymer blend of two $\alpha$-olefin polymers of different densities.

Such a dielectric material is previously known from U.S. Pat. No. 4,202,086 which states that the dielectric material may comprise some polyolefinic blend, advantageously a HDPE/LDPE blend with a HDPE content of 20 to 80%.

The disadvantages of the known solution lie, among other things, in its low foaming degree (about 70%), the relatively high loss factor, and the shrinkage proneness of the product, this being related to poor foam structure.

In the present invention it has surprisingly been found that by bringing the blend of two polyolefins of different densities, i.e., low-density polyethylene and medium-density polyethylene, to a high foaming degree by physical foaming, a dielectric material is obtained with a small dissipation factor and low relative permittivity.

A high foaming degree (exceeding 75%, preferably about 77 to 85%), is advantageously obtained by using a blend composition having a good melt strength.

According to a preferred embodiment of the invention, a dielectric material is used containing medium-density polyethylene (MDPE) and low-density polyethylene (LDPE), whereby the amount of MDPE is at least half of the weight of the polymer blend. The MDPE thus forms the matrix of the polymer blend. A small dissipation factor and relative permittivity presuppose polyethylenes which are as pure as possible, wherefore such a polymer blend only contains a small amount of admixture, such as a plastics stabilizing agent, at the most, in addition to the medium-density polyethylene and the low-density polyethylene. Catalyst residues must be avoided.

It has been found in connection with the invention that by blending a low-density polyethylene with a medium-density polyethylene, a material is obtained having the high melt strength required by the invention, which material can then be foamed to have a high foaming degree.

As an example of an advantageous dielectric material a foamed polymer blend may be cited containing 1 to 50% by weight of a LD polyethylene and 50 to 99% of a medium-density polyethylene, whereby the blend has a density of 0.931–0.939 g/cm$^3$, a melt flow rate (MFR) of about 1.5–4.5 dg/min and a loss factor (when unfoamed) of smaller than or equal to 0.0002 rad at 1 GHz.

Advantageously, the density of the polymer or plastics blend contained in the dielectric material is about 0.931 to 0.939, its melt flow rate (MFR is about 1.5 to 4.5, and its antioxidant content is less than 800 ppm. Advantageously, the polymer blend contains about 20–40 wt.-% of LD polyethylene, about 80–60 wt.-% of MD polyethylene and about 10–800 ppm stabilizer (in regard to the weight of the major components). This type of composition has excellent dielectric properties: its dissipation factor when unfoamed is smaller than 0.0002 within the frequency range 100 to 3000 MHz.

Most advantageously, the dielectric material contains a small amount (less than 1000 ppm) of a nucleating agent, which may possibly be included in the polyolefin component, e.g., the high-density polyethylene, serving to disperse the polyethylene component homogeneously into the polymer blend. The amount of this polyolefin component is typically less than 20 wt.-% in the blend.

Between the dielectric material of the coaxial high-frequency cable, which is blended from two polyolefin grades of different densities, and the conductors of said cable, are adapted two additional layers serving for improved adherence and protection, respectively, with a thickness in the range 1–500 $\mu$m, advantageously 10–100 $\mu$m. Most appropriately, between the dielectric and the inner conductor is adapted an adherence-improving layer made from the same polymer blend as is used in the dielectric. However, the adherence layer is herein made from unexpanded polymer blend. The two additional layers give protection to the dielectric material during the cable manufacturing process. The homogeneous polyolefin layer coextruded on top of the foam layer protects the expanded structure against mechanical strain and moisture.

The invention offers significant benefits.

The foamed dielectric material according to the invention has two important advantages in coaxial cables:

1. Lower loss in the polymer dielectric, which means a smaller longitudinal attenuation of the cable.
2. Higher foaming ratio, which means a higher characteristic impedance and lower attenuation of the cable.

The expanded dielectric material according to the invention has a polymer dielectric dissipation factor of about $55\times10^{-6}$ rad at about 80% degree of foaming. Earlier known polymer blends have had a dissipation factor of about $80\times10^{-6}$ rad. Such a loss reduction means an about 0.5 dB (15%) lower cable attenuation at, e.g., 1800 MHz.

Due to the improved melt strength, it has been possible to increase the degree of foaming from the conventional level of below 75% to about 82% and even beyond that.

The impact of the new qualities on the attenuation of the cable will be evident from an example to be described later, in which example the cable attenuation characteristics of the dielectric material according to the invention as a function of frequency are compared to those achievable by a prior-art material.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention will be examined in greater detail with the help of exemplifying embodiments illustrated in the appended drawings in which.

DETAILED DESCRIPTION OF THE PREFERRED EMBODIMENT

Figure 1:
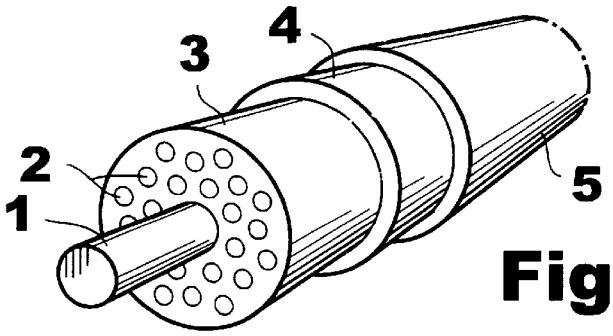
FIG. 1 shows a perspective view of a high-frequency cable according to the invention.

Referring to FIG. 1, a high-frequency cable comprises an inner conductor 1 surrounded by a dielectric medium 3. Typically, the dielectric material contains cells 2 which improve its electrical properties. The dielectric 3 is enclosed by the outer conductor 4 which is further covered by a sheath 5.

Generally, the inner conductor 1 is a smooth copper wire. If a particularly high flexibility of the cable is required, the inner conductor 1 is made from a stranded, multi-wire conductor. If the cable dimensions are sufficiently large and the transmission frequencies sufficiently high, savings in material costs can be attained by replacing the core of the inner solid-copper conductor with a cheaper material such as aluminium or by using a tubular copper conductor. These alternatives are made possible by the fact that at high frequencies the so-called skin-effect forces the current to run along a very shallow depth of the conductor outer surface. If the smallest possible attenuation is desired, the conductivity of the inner conductor can be further improved by silver-plating the conductor.

At high frequencies, the attenuation of a coaxial cable can be written as follows:

$$\alpha = 9.95\cdot10^{-6}\sqrt{f}\,\sqrt{\varepsilon_r}\,\frac{1}{a\sqrt{\sigma_a}} + \frac{\frac{1}{b\sqrt{\sigma_b}}}{\log\frac{b}{a}} + 9.10\cdot10^{-8}\sqrt{f}\cdot\varepsilon_r\cdot\tan\delta$$

wherein $\alpha$=attenuation [dB/m]

f=frequency [Hz]

$\epsilon_r$=relative permittivity a=inner conductor radius [m]

b=outer conductor radius [m]

$\sigma_a$=inner conductor conductivity [S/m]

$\sigma_b$=outer conductor conductivity [S/m]

tan $\delta$=dissipation factor.

It can be seen from the above-given formula of cable attenuation that, besides the diameter ratio of the inner and outer conductors of the cable, the factors determining the attenuation of the cable include the conductivity of the cable conductors, frequency, the relative permittivity and dissipation factor of the dielectric. Herein, the governing parameters are the cross-sectional dimensions of the cable, wherein larger dimensions give lower attenuation, and the effective permittivity and dissipation factor of the dielectric structure, which must be as low as possible to achieve a low-loss cable.

In order to retain the practical handling properties of cables, the dimensions of cables can hardly be increased from those currently employed; and when the operating frequencies reach as high as several GHz, the upper frequency limit of the cable due to the TEM mode is confronted quite soon.

While silver is a metal with superior conductivity properties over those of copper, its price and processability form an effective hindrance to its use.

Resultingly, the only feasible approach to the reduction of attenuation in concurrent cables is to improve the dielectric medium and its structure.

Figure 2:
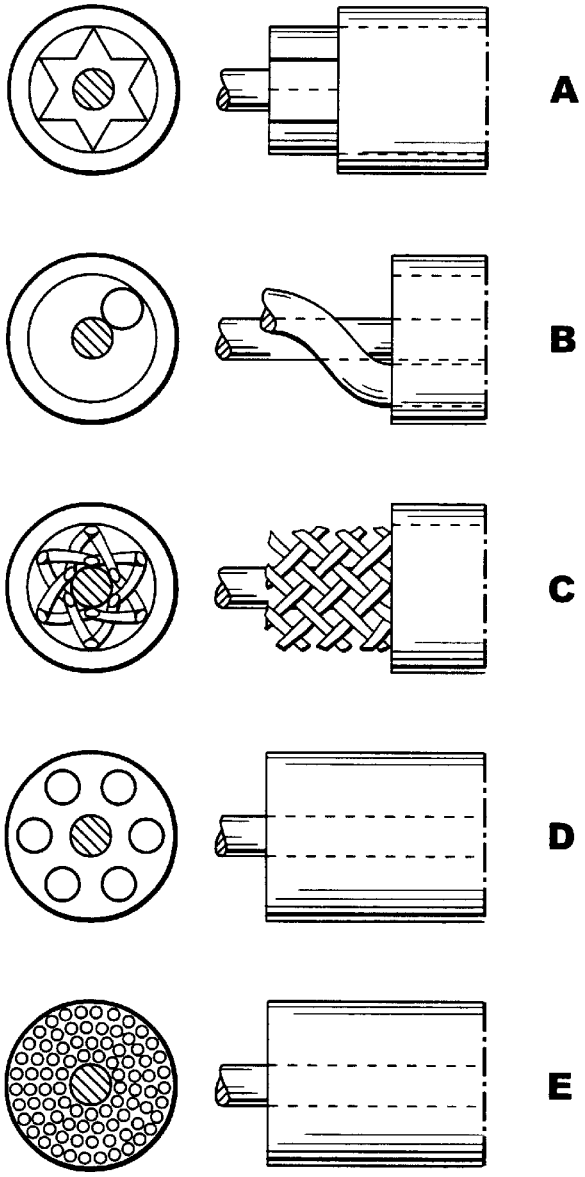
FIG. 2 shows examples of alternative cable structures according to the invention.

In FIG. 2 are shown a few examples of air-expanded polymer dielectric structures. Today, the most common of these is the structure of type E having its dielectric formed by expanded polyethylene, in some cases complemented with outer layers of solid polymer to improve its mechanical qualities.

The outer conductor 4 is most generally a metal tube made from copper or aluminium, for instance. The metal tube 4 may be made hermetic by welding or be formed from a longitudinally running circularly shaped metal strip or an overlappingly obliquely wound metal foil. When a particularly high flexibility is required from the structure, the outer conductor is made from thin braided or knitted copper wires. Cables intended for CATV or data transmission frequently use polymer-coated metal foil lap combined with such braiding or knitting.

If the outer conductor is made from a welded metal tube, it may be corrugated to improve the flexibility of the cable. In large-dimension cables, also the inner conductor can be corrugated.

Onto the outer conductor 4 of the coaxial structure is generally extruded an outer sheath 5 made conventionally from UV-stabilized polyethylene or PVC depending on the needs of the operating environment. Certain cable types intended for indoor installations are today provided with halogen-free engineering polymers featuring flame retardancy and low smoke evolution.

The principal goal of research and development in the art of polymer dielectric blends is to achieve an expandable polymer blend with a low electrical dissipation factor combined with good melt strength. The target of a low dissipation factor is essentially connected with the technology used in the production of the polymer. Only a suitable reactor type and proper catalyst technique can assure a sufficiently impurity-free polymer quality for electrical use.

Both components of the novel expandable polymer blend are made in a low-pressure reactor.

Another important quality requested from a polymer dielectric blend is a high melt strength. In the foaming process, the melt strength of the polymer refers to self-strengthening property which is required when the polymer is subjected to intense stretching during the formation of a cell. This means that the polymer film undergoes greatest strengthening at the area of largest elongation. Such a property makes it possible to produce a cellular structure with a thin, polygonal cell wall. The planar cell wall structure and small-volume nodes at the corner points of the walls facilitate a high foaming ratio.

A degree of foaming of up to 70% is easily achieved by means of a spherical cell structure. The novel polymer dielectric material makes it possible to achieve a degree of foaming of more than 75%, preferably up to 82% or even higher. The good melt strength qualities of the blend are obtained by mixing two polymer grades of low dissipation factor in a proper ratio with each other. In production, the extrusion temperature of optimum melt strength of the polymer blend must fall within the temperature control limits of the foaming extruder. The optimum melt temperature of the novel polymer blend is 170° C.±2° C. This temperature is well compatible with current foaming extrusion technology.

The polymer dielectric blend according to the invention is a compounded polymer material (polymer blend) which consists of the blend of two α-olefin polymers of different densities. While both polyolefins can be included in equal amounts in the blend, advantageously, the polymer of higher density forms the matrix (continuous phase) of the polymer blend. The polyolefins can be selected from the groups of polyethylenes or polypropylenes. Most advantageously, the polymer blend is made from a low-density polyethylene (LDPE) and a medium-density polyethylene (MDPE), particularly, linear medium-density polyethylene. The density of the low-density polyethylene used in the invention is typically about 0.910–0.930, advantageously about 0.920–0.928, and the medium-density polyethylene has a density of about 0.930–0.945, advantageously about 0.937–0.943. It has been found that through the modification of the mechanical and rheological qualities of the medium-density polyethylene, which forms the matrix of the blend, by blending it with a low-density polyethylene, a particularly suitable material with good melt strength and dielectric properties for use as the dielectric of cables can be achieved. As examples of LD polymers, the following may be cited: DFDA 1253 (Union Carbide), BPD 8063 and BPD 2007 (BP), LE 1169, LE 4004, LE 40227, LE 4S10, and LE 4524-D (Borealis). As examples of medium-density polymers, then, the following may be cited: ME 1831, ME 1835, MIM 4034, and ME 6032. Advantageously, some (1 to 20% by weight, preferably about 2 to 15% by weight) high-density PE may further be admixed with the material. Examples of HDPE products include DGDA 6944 (Union Carbide), HE 1102 and HE 6930 (Borealis).

According to the invention, an LDPE grade is preferably used having an MFR of about 3.0–5.5, and an MDPE grade having an MFR of 2.0 to 5. The dissipation factor of the polyethylene grades when unexpanded within the frequency range 100 to 3000 MHz should preferably be smaller than 0.00025 rad and, correspondingly, 0.0002 rad.

Advantageously, the polymer blend contains about 1–50 wt.-% of LDPE, about 50–99 wt.-% of MDPE and maximally about 0.1 wt.-% (that is, 1000 ppm, compared to the weight of the other components) of plastic additives and admixtures known as such. Most appropriately, the polymer blend contains about 10–45 wt.-%, advantageously about 20–40 wt.-%, of LDPE, and about 85–55 wt.-%, advantageously about 80–60 wt.-%, of MDPE, and less than 800 ppm (compared to the weight of the other components) of a stabilizer (an antioxidant).

As noted earlier, a polymer blend according to a particularly preferred embodiment of the invention has a density of about 0.931–0.939, an MFR of about 1.5–4.5, a dissipation factor when unexpanded within the frequency range of 100 to 3000 MHz smaller than 0.0002, and an antioxidant content smaller than 800 ppm.

As will be evident from the example described below, these particularly good qualities are attained by using a polymer blend containing LDPE and MDPE in the weight ratio 1:1.5–1:4, e.g., in the ratio 1:3.

Conventionally, both LDPE and MDPE contain comonomers, such as higher α-olefins including propene, butene, 4-methylpentene, 1-hexene and/or 1-octene, or vinyl acetate. By varying the comonomer content, the qualities of polymers such as crystallinity and strength can be modified.

Preferably, the polymer blend should be as free as possible from plastic additives and adjuvants which may impair the dielectric properties of the material. Particularly detrimental herein are polar additives and impurities. Hence, the polymer blend according to the invention most appropriately contains only an antioxidant in an amount of about 50–1000 ppm, most advantageously 750 ppm at the most. Of the group of suitable stabilizers, tetrakis[methylene(3.5-ditertiary butyl-4-hydroxy-hydrocinnamate)] methane may be mentioned.

The polymer is expanded in an extruder. High-pressure nitrogen gas at a pressure of about 500 bar is injected into the extruder cylinder. The volume flow rate of the nitrogen gas is controlled by varying the pressure and the cross-sectional area of the extrusion nozzles. The gas first dissolves into the molten polymer. When the polymer starts to flow out from the extruder die, the gas dissolved in the polymer melt is liberated thus effecting the foaming of the material.

In order to achieve a high degree of expansion, it is necessary to combine a properly formulated expandable polymer blend with an exactly controlled gas flow rate and an additive that sets the cell size to a desired volume during foaming. One suitable additive acting as such a nucleating agent is azodicarbonamide. The parameters characterizing the use of this additive are as follows:

- a suitable particle size distribution in the range of about 5–15 $\mu$m;
- a suitable decomposition temperature of about 200° C.;
- electrical purity (freedom from metallic compounds of polar nature) is required;
- a suitable amount for foaming is added of about 150–180 ppm; and
- the additive must be homogenously compounded in the polymer blend.

While the nucleating agent can be mixed directly as such into the expandable polymer blend, it may also be precompounded with a polyolefin grade which is next compounded with the expandable dielectric material. An example of a suitable polyolefin is HDPE, for instance expandable polymer dielectric materials for high-frequency use. A correct blending ratio with homogeneous compounding can be attained by blending this material in an amount of 1–20%, advantageously about 2–15%, with the expandable polymer dielectric material. The compounding step is effected by means of a mixing apparatus adapted above the inlet opening to the hopper of the extruder. The nucleating agent can be added to the polyolefin in an amount of about 100–800 ppm, typically about 200–600 ppm.

When desired, between the expanded dielectric and the inner conductor can be formed a thin adherence layer which typically has a thickness of about 10–200 $\mu$m and consists of a polyolefin material. Particularly advantageously the adherence layer is made from the same material as the polymer blend, whereby the polymer may be compounded with a small amount (0.01–0.5%) of an adhesion-improving agent such as a functionalized polyethylene, for instance, a copolymer of ethylene and acrylic acid, if so desired. Similarly, between the expanded dielectric and the outer conductor can be arranged a thin skin layer serving to prevent the puncture of the outermost cell layer and the subsequent penetration of water into the dielectric during the cable manufacturing process. The skin layer is comprised of LDPE, LLDPE, MDPE, HDPE or PP, for instance. The thickness of the outermost skin layer is in the same order with that of the above-mentioned adherence layer.

The type of the exemplifying cable is RF 1⅝–50 with the following characterizing dimensions:

| | |
|---|---|
| Inner conductor | 17.3 mm |
| Dielectric | 42.5 mm |
| Outer conductor | 46.5 mm |
| Sheath | 50 mm |

The dielectric is made from an expandable polymer blend having the following composition:

- 24% of a low-density PE (density 0.924, MFR 4.2)
- 76% of a linear, medium-density PE (density 0.940, MFR 3.5)
- 600 ppm (as computed from the total amount of the LDPE and the MDPE listed above) of a stabilizer (an antioxidant).

The properties of this blend are a density of about 0.935, an MFR of about 3.0, and a dissipation factor when unexpanded within the frequency range of 100 to 3000 MHz which is smaller than or equal to 0.0002.

Of the expanded dielectric, 90% consists of the above-described blend and 10% is of an HD polyethylene grade containing 400 ppm of azodicarbonamide as the nucleating agent.

Between the expanded dielectric and the inner conductor is adapted an about 50 $\mu$m adherence layer made from the same material as is used in the polymer blend, which contains a small amount of 0.2 ethylene acrylic acid. Correspondingly, between the expanded dielectric and the outer conductor is adapted a 50 $\mu$m skin layer made from LLDPE plastic.

For the comparative test (cf. area 15 of FIG. 4), a cable was made according to a conventional technique having its dielectric extruded from a blend of 90% LD polyethylene and 10% HD polyethylene. 150 ppm azodicarbonamide was used as the nucleating agent.

Figure 3:
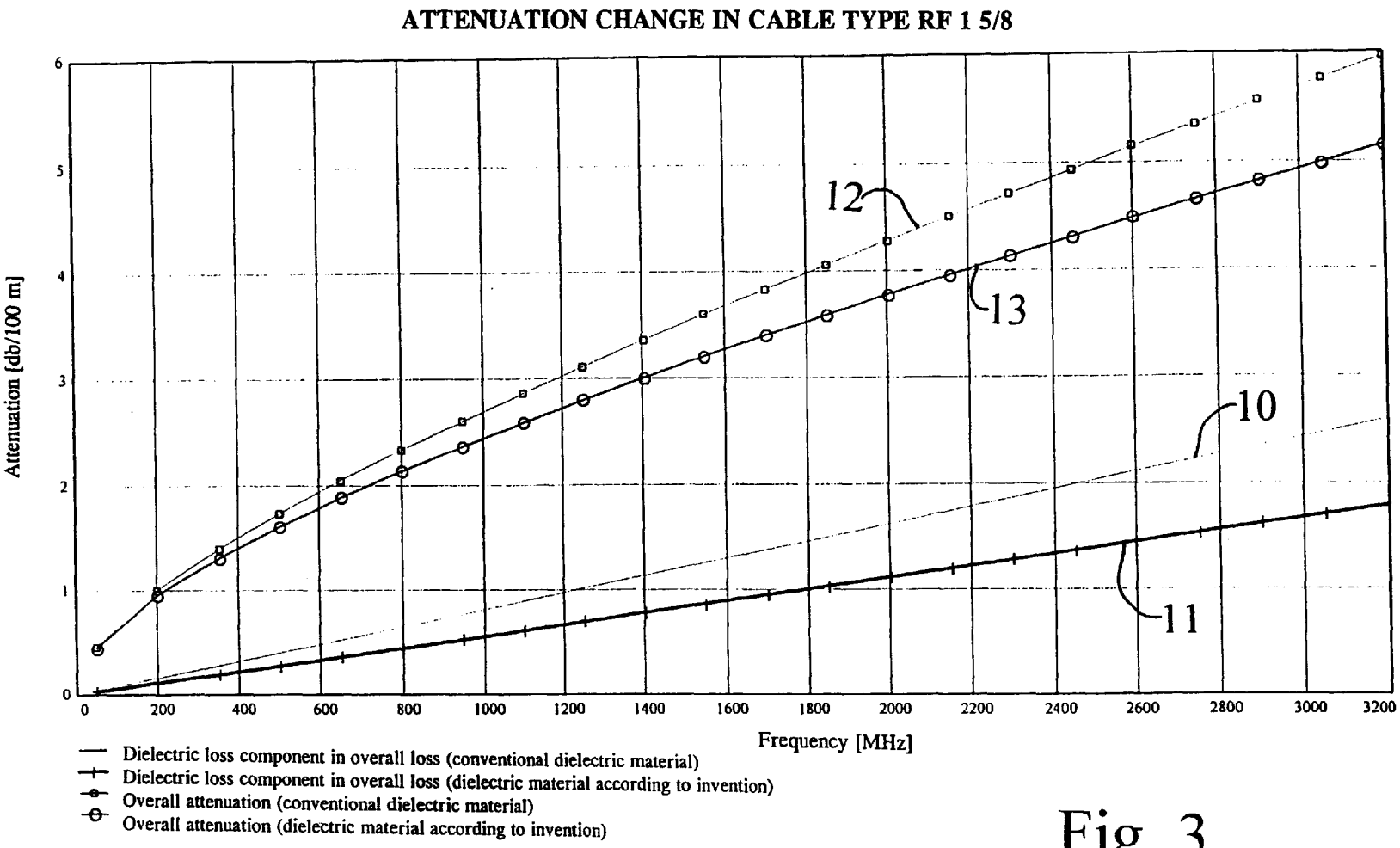
FIG. 3 shows a plot of the attenuation of a cable according to the invention as compared to the attenuation of a prior-art cable.

Referring to FIG. 3, therein are plotted comparative attenuation vs. frequency measurement results of a cable according to the invention and a cable according to the prior art. As is evident from the curves, e.g., at the frequency of a recently allotted frequency band (1800 MHz), the attenuation curve 12 of the prior-art cable is about 0.5 dB higher than the attenuation curve 13 of the cable according to the present invention. This corresponds to an about 15% improvement in favour of the present invention. In other words, the cable according to the invention transmits 15% more electrical power to the remote end such as a base station antenna than a conventional cable construction. Further, curve 10 shows the fraction of a prior-art dielectric material in the cable overall attenuation and, respectively, curve 11 shows the fraction of a dielectric material according to the invention in the cable overall attenuation.

Figure 4:
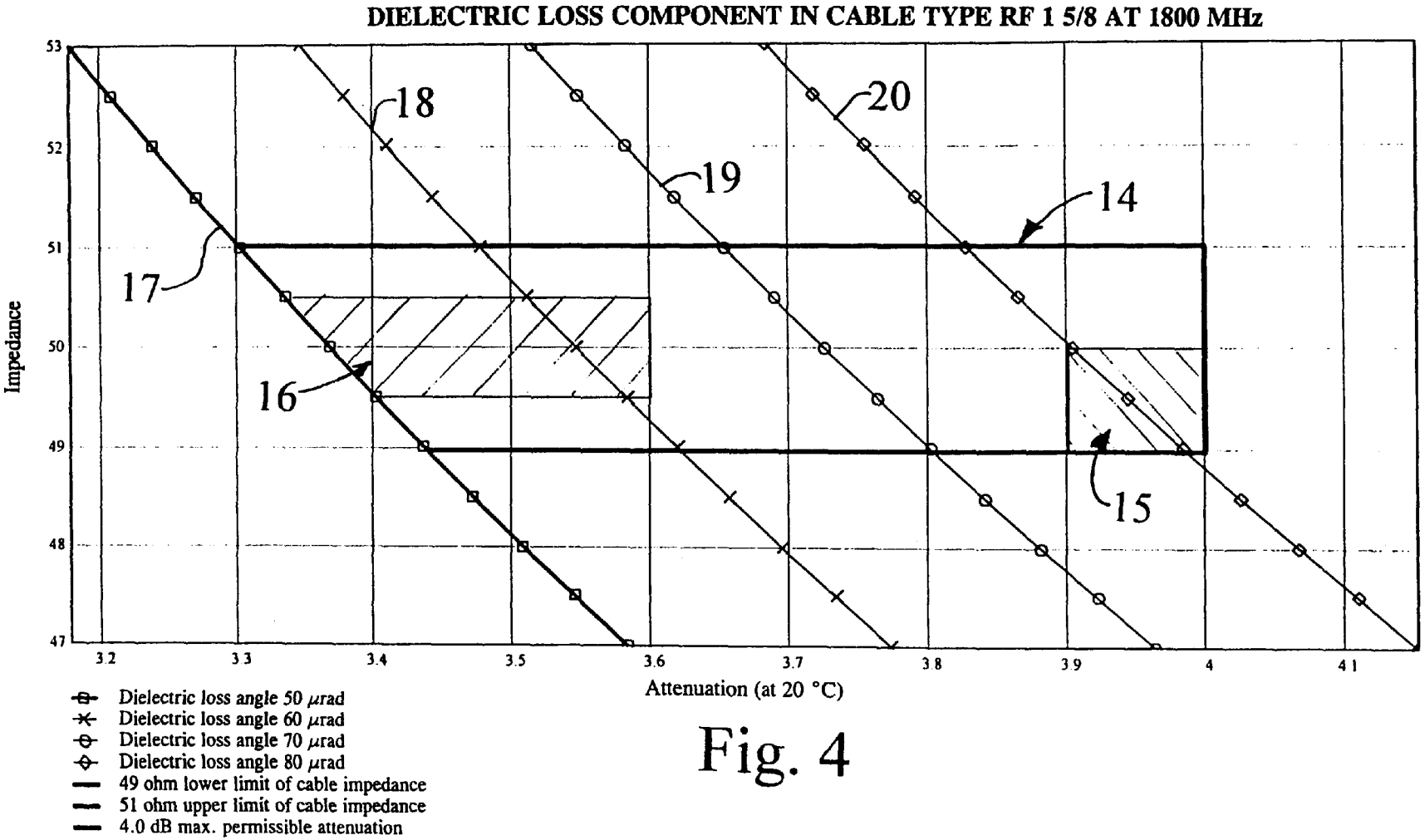
FIG. 4 shows a plot of the electrical properties of cables made according to the invention and the prior art.

In FIG. 4 are compared the electrical properties of different types of polymer dielectric blends. Area 14 represents the basic acceptable qualities required from a cable. The vertical axis represents the characteristic cable impedance and the horizontal axis the cable attenuation. The target impedance is 50 ohm with a permissible deviation range of ±1 ohm and the maximum permissible attenuation is 4 dB/100 m at 1800 MHz. Area 15 indicates the impedance and attenuation values achievable by conventional polymer dielectric blends which are only just within the permissible limits. Correspondingly, the polymer blend according to the invention reaches the values indicated by area 16, wherein the average attenuation is about 0.5 dB lower than that of area 15. The polymer dielectric loss curves 17 and 18 represent the characteristic impedances of cables made from the expandable polymer dielectric material according to the invention at different degrees of expansion and, correspondingly, the polymer dielectric loss curves 19 and 20 represent the characteristic impedances of cables made from the expandable polymer dielectric material of the prior art at different degrees of expansion.

The basic cable structure made according to the invention is a coaxial low-loss antenna feeder cable. Another application of the invention is a radiating cable for cellular telephone networks. This structure has a perforated outer conductor.

CATV cables used in cable television networks differ chiefly by their outer conductor of a simpler and lower cost structure, as well as by having different dimensions. The cables used in wideband access networks are similar in structure to the cables of CATV networks.

Wideband cables of data transfer networks differ from the above-described types by having a twin-conductor structure.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A coaxial high-frequency cable comprising:

an inner conductor;

a dielectric material formed about said inner conductor; and an outer conductor formed about said dielectric material, wherein said dielectric material is a blend of a low-density polyethylene and a medium-density polyethylene expanded by physical foaming to a high degree of expansion, the dissipation factor of the dielectric material being $55\times10^{-6}$ rad at the most within the frequency range from 100 to 3000 MHz.

2. The cable as defined in claim 1, wherein said dielectric material has a degree of expansion of at least 75%.

3. The cable as defined in claim 1, wherein the polyethylene having the higher density forms a matrix of the polyethylene blend.

4. The cable as defined in claim 1, wherein the polyethylene blend has a density of 0.931–0.939, an MFR of 1.5–4.5 and a dissipation factor when unexpanded within the frequency range of 100 to 3000 MHz which is lower than or equal to 0.0002 rad.

5. The cable as defined in claim 1, wherein said polyethylene blend contains a nucleating agent in an amount of about 10–1000 ppm.

6. The cable as defined in claim 1, wherein said polyethylene blend contains about 1–50 wt.-% of a low-density polyethylene and 50–99 wt.-% of a medium-density polyethylene and maximally about 0.1 wt. -% of a stabilizer.

7. The cable as defined in claim 6, wherein said polyethylene blend contains about 20–40 wt.-% of a low density polyethylene and about 80–60 wt.-% of a medium-density polyethylene and maximally about 800 ppm of a stabilizer.

8. The cable as defined in claim 1, wherein between the inner conductor and the dielectric is an adherence layer containing the same polyethylene blend as the dielectric material.

9. The cable as defined in claim 8, wherein the thickness of said adherence layer is about 10–1000 $\mu$m.

10. The cable according to claim 1, wherein a homogeneous polyolefin layer is coextruded on the foam layer, the polyolefin layer protecting the foamed structure from mechanical strain and moisture.

11. A coaxial high-frequency cable comprising.

an inner conductor;

a dielectric material formed about said inner conductor; and an outer conductor formed about said dielectric material, wherein the dielectric material comprises an expanded polymer blend containing 1 to 50 wt-% of a low density polyethylene and 50 to 99 wt-% of a medium density polyethylene and has a density of 0.931–0.939, a melt index of 1.5 to 4.5 and a dissipation factor at 1 GHz of less than or equal to 0.0002 rad.

12. A cable dielectric material made from an expandable polymer material comprising a polymer blend which consists essentially of a compounded blend of a low density polyethylene and a medium-density polyethylene and having a density of 0.931 to 0.939, a melt index of 1.5 to 4.5 and a dissipation factor when unexpanded within the frequency range from 100 to 3000 MHz of less than or equal to 0.0002 rad.

13. The cable dielectric material according to claim 12, wherein the polymer of higher density forms the matrix of the polymer blend.

14. The cable dielectric material as defined in claim 12, wherein said polymer blend contains about 1–50 wt.-% of a low-density polyethylene and 50–99 wt.-% of a medium-density polyethylene and maximally about 0.1 wt.-% of a stabilizer.

15. The cable dielectric material as defined in claim 14, wherein said polymer blend contains about 20–40 wt.-% of a low-density polyethylene having a density of about 0.920–0.928, an MFR of 3.0–5.5 and a dissipation factor when unexpanded within the frequency range from 100 to 3000 MHz which is smaller than 0.00025 rad, and about 80–60 wt.-% of a medium-density polyethylene having a density of about 0.937–0.943, an MFR of 2.0–5.0 and a dissipation factor when unexpanded within the frequency range from 100 to 3000 MHz which is smaller than 0.0002 rad, and maximally about 800 ppm of an antioxidant.

16. The cable dielectric material as defined in claim 12, wherein said polymer blend contains 10–800 ppm of tetrakis {methylene(3,5-ditertiary butyl-4-hydroxy-hydrocinnamate)}methane as a stabilizer.

17. The cable dielectric material as defined in claim 12, wherein the cable dielectric material contains 10–1000 ppm of a nucleating agent.

18. The cable dielectric material as defined in claim 12, wherein said polymer blend contains 1–20% of an additional polyolefin.

* * * * *